US007350626B2

(12) United States Patent
Lence et al.

(10) Patent No.: US 7,350,626 B2
(45) Date of Patent: Apr. 1, 2008

(54) POWER-ON-RESET OF ELEVATOR CONTROLLERS

(75) Inventors: Juan A. Lence, Madrid (ES); Samuel R. Talbot, Marlborough, CT (US)

(73) Assignee: Otis Elevator Company, Farmington, CT (US)

( * ) Notice: Subject to any disclaimer, the term of this patent is extended or adjusted under 35 U.S.C. 154(b) by 501 days.

(21) Appl. No.: 10/970,739

(22) Filed: Oct. 20, 2004

(65) Prior Publication Data

US 2006/0081421 A1 Apr. 20, 2006

(51) Int. Cl.
*B66B 1/34* (2006.01)
*B66B 3/00* (2006.01)

(52) U.S. Cl. ..... 187/393; 187/247

(58) Field of Classification Search ..... None
See application file for complete search history.

(56) References Cited

U.S. PATENT DOCUMENTS 3,973,648 A * 8/1976 Hummert et al. ..... 187/393
4,512,442 A * 4/1985 Moore et al. ..... 187/393
4,630,026 A * 12/1986 Lewis ..... 187/399
4,697,243 A * 9/1987 Moore et al. ..... 706/59
4,750,591 A * 6/1988 Coste et al. ..... 187/391
4,771,865 A 9/1988 Hinderling et al.
4,930,604 A * 6/1990 Schienda et al. ..... 187/393
5,450,478 A * 9/1995 Christy et al. ..... 379/106.01
5,551,532 A * 9/1996 Kupersmith ..... 187/391
5,557,546 A * 9/1996 Fukai et al. ..... 702/185
5,817,994 A * 10/1998 Fried et al. ..... 187/391
7,073,633 B2 * 7/2006 Weinberger et al. ..... 187/393
2004/0094366 A1 5/2004 Weinberger et al.

FOREIGN PATENT DOCUMENTS

JP 2000044154 A 2/2000
JP 2002009882 A 1/2002

* cited by examiner

*Primary Examiner*—Lincoln Donovan
*Assistant Examiner*—Eduardo Colon

(57) ABSTRACT

An elevator (9) includes remote elevator monitoring equipment (10) connected by a communication linkage (12) to a central elevator monitoring and control station (11). Main, drive, and door controllers (16-18) are interconnected (19-21) with the monitor lines. Power-on-reset (POR) of controllers may be caused internally or by remotely-operable power relays (23-25) which interrupt power to the controllers. Maintenance personnel at the remote station (11) may order a POR through the communication linkage. In another embodiment, the remote elevator monitor (10) determines presence of a malfunction which a POR may cure and causes a POR internally or by a power relay. In another embodiment, the controller (16*a*) includes, in its program routines, elevator diagnostics (50) which can recognize an elevator malfunction which a POR may cure, and either cause the relay to interrupt power for an interval or cause an internal POR.

6 Claims, 3 Drawing Sheets

POWER-ON-RESET OF ELEVATOR CONTROLLERS

TECHNICAL FIELD

This invention relates to providing a power-on-reset (POR) of one or more controllers of an elevator without a maintenance person visiting the site of the elevator, including a remote monitoring and control center providing a POR signal over communication linkage, a local elevator monitoring device providing a POR signal, and elevator diagnostic program routines within a controller providing a POR signal; the POR may be performed internally of the controller or by means of power relays, which may include electronic switches.

BACKGROUND ART

Remote monitoring of elevator conditions has become common. The status of various elements and various operational parameters of the elevator are typically sent by a communication link, which may be telephone or some other media, to a central monitoring and control station. Remote elevator monitoring of this sort may be as disclosed in U.S. Pat. Nos. 4,568,909, 4,622,538 5,450,478, and more modern systems which have evolved therefrom.

A typical response to an elevator malfunction that requires immediate attention is dispatching service personnel on a service call to the site of the elevator. Performing an on-site service call delays the point in time when correction of the malfunction will occur. Service calls are also costly.

DISCLOSURE OF INVENTION

Objects of the invention include: reducing the number of service calls required by elevators being monitored; reducing the cost of restoring elevators after malfunctions have been detected; reducing the time required to correct an elevator malfunction in certain cases; avoiding unnecessary service calls to elevator sites; and improved elevator monitoring and servicing.

This invention is predicated on the recognition that a significant number of elevator service calls require no more than causing a power on reset of one or more controllers (main controller, door controller, or drive controller) by the maintenance personnel, once on site.

In accordance with the present invention, an elevator malfunction, detected either by a related elevator controller or remote elevator monitoring equipment, for which a power on reset (POR) of the controller may provide either a cure or additional information useful in determining the cure of the malfunction, is accomplished without the aid of on-site maintenance personnel either by interrupting the electric power supplied to the controller or by causing the controller to perform an internal POR.

According to the invention in one form, a power relay (which may consist of a moveable armature switch or electronic switches) of an elevator controller (which may comprise a main controller, a door controller, a drive controller, etc.) is accomplished without the aid of on-site maintenance personnel by operating a remotely operable power relay from which the controller derives power. According to the invention, the power relay of the controller may be operated by (a) remote monitoring and control personnel sending a signal over a communication link, by (b) on-site elevator monitoring equipment, or by (c) computer programs which perform elevator diagnostics within the controller itself.

According to the invention in another form, an elevator controlled is caused to be re-booted (in a manner similar to a control/alt/delete re-boot in a personal computer), without the aid of on-site maintenance personnel; the re-boot may be caused by (a) remote monitoring and control personnel sending a signal over a communication link, by (b) on-site elevator monitoring equipment providing a signal to the controller, by (c) computer programs which perform self-test within the controller itself.

The invention allows providing a power-on reset without the intervention of on-site maintenance personnel, in response to monitoring equipment or off-site personnel determining an elevator malfunction which a POR may cure or provide additional, useful information. Examples of malfunctions for which a POR is not useful include a problem with a load weighing device or an open safety chain.

Other objects, features and advantages of the present invention will become more apparent in the light of the following detailed description of exemplary embodiments thereof, as illustrated in the accompanying drawing.

MODE(S) FOR CARRYING OUT THE INVENTION

Figure 1:
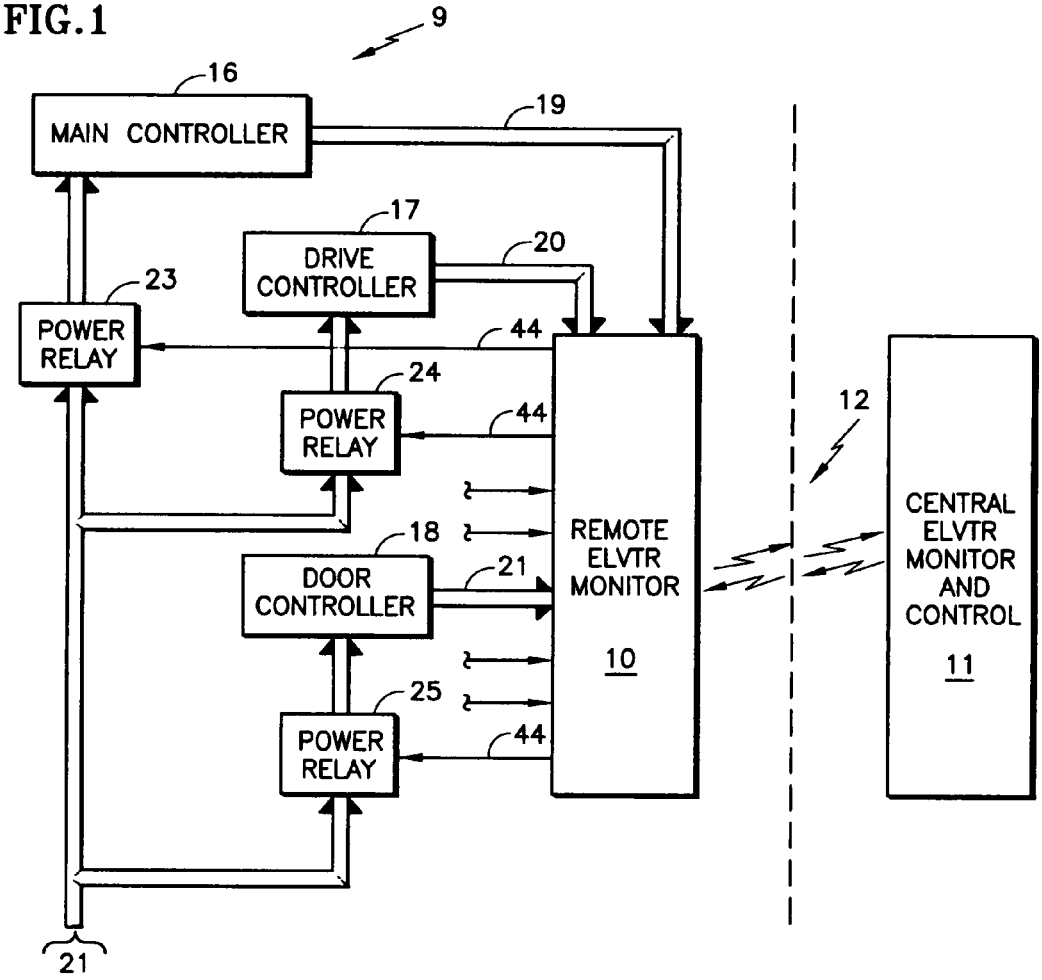
FIG. 1 is a simplified, stylized block diagram of embodiments of the invention employing a remote elevator monitor.
Figure 2:
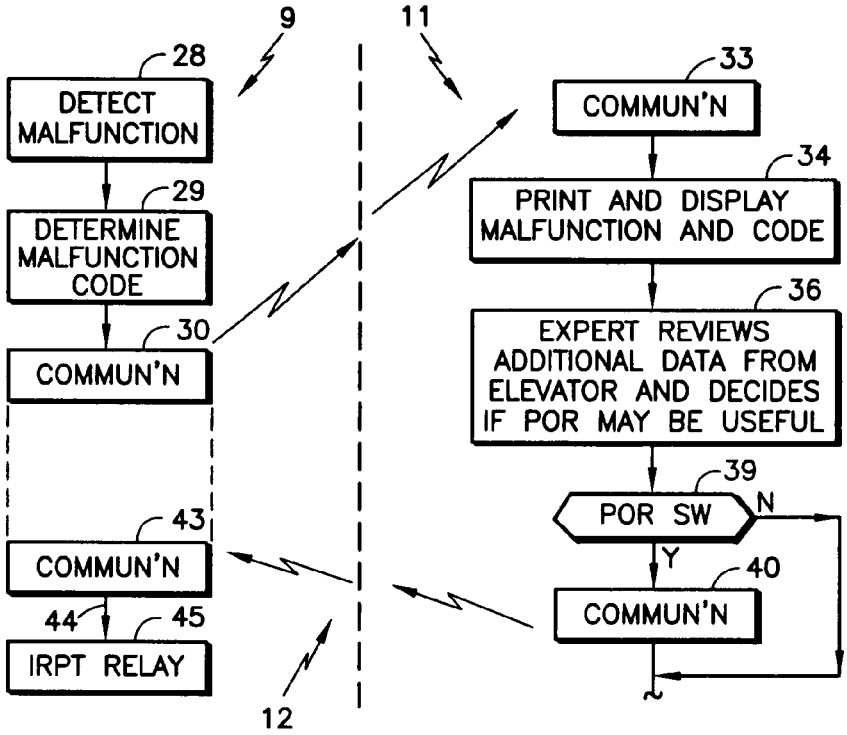
FIG. 2 is a simplified diagram of functions which may be performed in carrying out the operational strategy of one embodiment of the invention controlled by off-site maintenance personnel.

Referring to FIG. 1, an elevator system 9 may include a remote elevator monitor 10 which communicates with a central elevator monitoring and control station 11 over communication linkage 12, which may be telephone, RF, infrared or any other desired medium.

The elevator 9 may have a main controller 16 and may also have a drive controller 17 and/or a door controller 18; except as described with respect to FIGS. 3-5 hereinafter, the controllers 16-18 are conventional. In some embodiments, each controller is connected to the remote elevator monitoring equipment 10 via signal lines 19-21. According to the invention in one form, each of the controllers 16-18 receive electrical power from a source 21 through a corresponding remotely operable power relay 23-25. The invention may be practiced with less than all of the controllers 16-18 being powered by remotely operable power relays 23-25. Or, more than one controller may be powered by a single relay. In a typical case there will be only one controller in an elevator; similarly, there will usually be only one power relay per elevator.

In one embodiment of the invention, the remote elevator monitoring equipment 10 will determine that a malfunction has occurred, and send a code of that malfunction over the communication linkage 12 to the central elevator monitoring and control station 11 by means of a suitable communication unit 30, which may be a modem. The remote monitoring and control station 11 will receive the malfunction code through communication equipment 33, which may comprise a modem, and typically will have steps 34 to print and display the malfunction code. These may be viewed by personnel who, in accordance with the prior art, will determine whether a service call should be made immediately or later, and perhaps provide suggested tests and potential causes of problems to aid service personnel in correcting the malfunction when service personnel arrive at the site of the elevator 9.

In accordance with the invention, in a next step 36 in the process of this embodiment of the invention, an expert reviews additional data which is displayed, indicating other status and operating conditions of the elevator. From this, the expert will decide whether a POR may possibly cure the malfunction or provide useful information. If the maintenance personnel presses a switch or otherwise indicates that a POR should be conducted, then a test 39 will be affirmative causing a POR transmission through communication equipment 40, which may be a modem; if a POR is not indicated, a negative result of test 39 will bypass step 40. If the POR signal is sent over the communication linkage 12, it will be received by a communication unit 43, which may be a modem, which will send a signal over one or more lines 44 to perform a step 45 that interrupts power through the power relays 23-25.

The communication units 30, 43 will typically comprise send and receive modes of a single modem, as will the units 33, 40.

In this embodiment, the powering of any controllers may be initially established by the remote monitoring and control station 11, and interrupted when appropriate in response to elevator malfunctions. The apparatus will typically be set up so that the power will remain off for some significant fraction of a minute or other suitable interval, and then the relay will be operated so as to restore power to the controller, thereby achieving a conventional POR of the computer.

The apparatus of FIG. 1 may have a different mode of operation in which the remote elevator monitoring equipment 10, at the site of the elevator 9, may determine that the code of a malfunction indicates one which a POR may cure or provide useful information, and cause a POR signal on one or more of the lines 44 to a corresponding one or more of the power relays 23-25.

Figure 3:
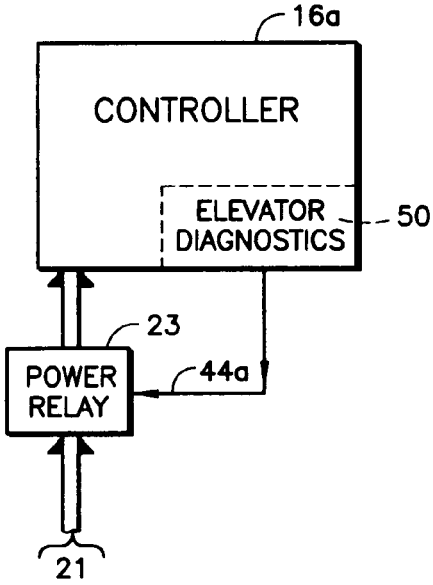
FIG. 3 is a simplified, stylized block diagram of an embodiment of the invention in which the controller provides its own power on reset.

FIG. 3 illustrates an additional embodiment of the invention in which the main controller 16*a* has, within its own programming routines, elevator diagnostics 50, which identify an elevator malfunction for which a POR is appropriate, and is able to transmit a signal on a line 44*a* to the power relay 23 to cause power to the controller 16*a* to be removed for an interval and then restored.

Figure 4:
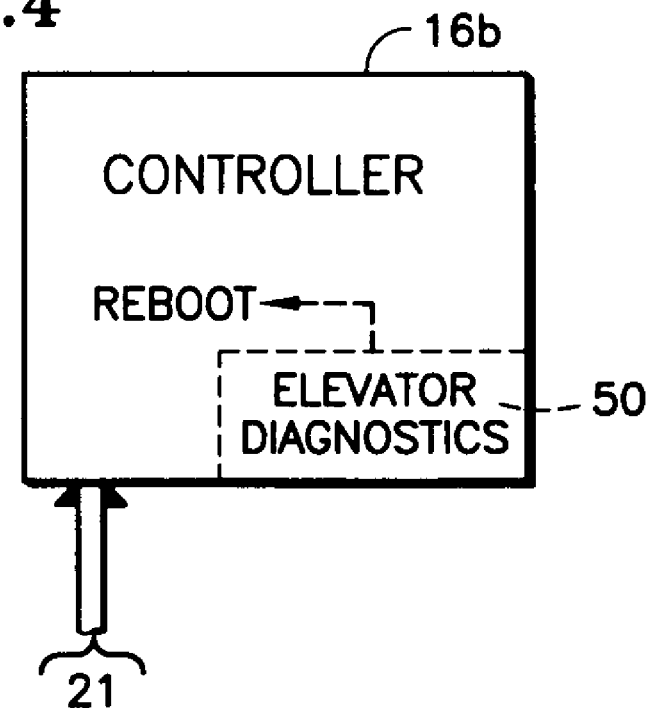
FIG. 4 is a simplified, stylized block diagram of an embodiment of the invention in which the controller reboots itself.

Referring to FIG. 4, another embodiment of the invention includes a controller 16*b* which receives power directly from the source 21, rather than through a power relay. In this embodiment, the elevator diagnostic programming routines 50 will command the controller to re-boot itself.

Figure 5:
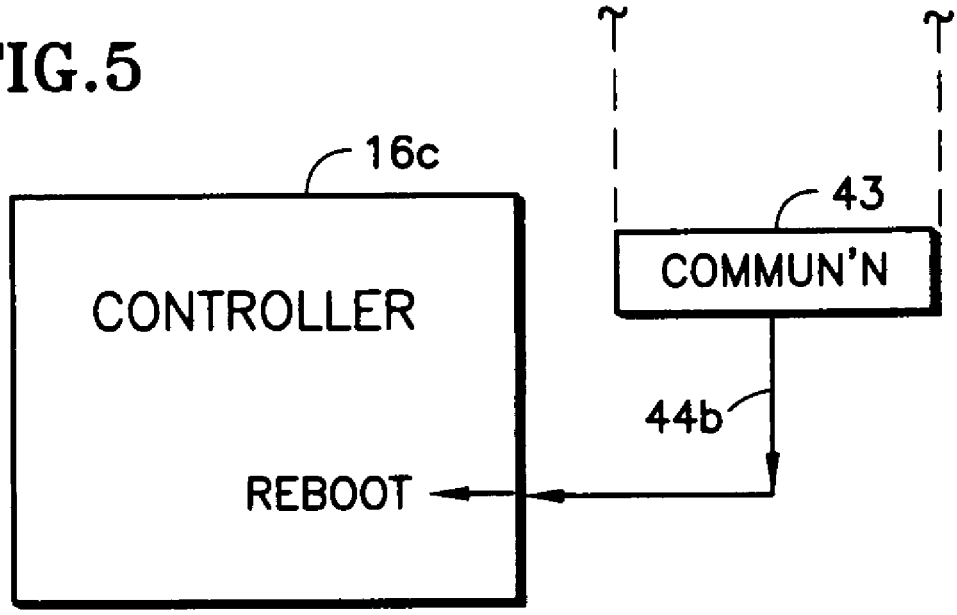
FIG. 5 is a partial, simplified, stylized block diagram of an embodiment of the invention in which the controller is caused to be re-booted remotely.

In FIG. 5, the communication unit 43 provides a signal on a line 44*b* to command a controller 16*c* to re-boot itself. In a variation of the embodiment of FIG. 5, the remote elevator monitor 10 may command the controller 16*c* to re-boot itself whenever the monitor 10 senses a malfunction for which a re-boot may be useful in either providing a cure or causing additional information relative to the status and conditions of the elevator to assist in determining the cure.

Thus, the invention may either interrupt the power to the controller, or cause the controller to re-boot itself.

The foregoing patents are incorporated herein by reference.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

The invention claimed is:

1. A method of providing potentially corrective action to an elevator system in response to elevator operation diagnostics sensing a malfunction, said elevator system having at least one controller, said method comprising:

causing a power-on-reset (POR) of one or more controllers in said elevator system by a process, independent of human intervention at the site of the elevator system, of operating, said process comprising one or more of (a) having on-site elevator monitoring equipment cause said POR when said monitoring equipment senses an elevator malfunction for which a POR may cure the elevator malfunction or provide information which may aid in determining the cause of the malfunction, or (b) providing, in program routines of said at least one controller, elevator diagnostics which cause said POR in response to recognition of an elevator malfunction for which a POR may cure the elevator malfunction or provide information which may aid in determining the cause of he malfunction.

2. A method according to claim 1 further comprising:

providing electric power to said at least one controller through a remotely operable power relay;

causing said POR by operating at least one said power relay to remove power from at least one aid controller for an interval and to then restore power to said at least one controller.

3. A method according to claim 1 wherein:

said POR is performed internally of said controller.

4. An elevator system, comprising:

an elevator having at least one controller and at least one car moving in a hoistway;

an elevator diagnostic function disposed in either or both of (i) said controller and/or (ii) a remote elevator monitor; and means operable in response to said diagnostic function sensing an elevator malfunction for which a power-on-reset (POR) of at least one said controller may cure the elevator malfunction and for causing a POR in at least one said controller independent of human intervention at the site of the elevator system, said means comprising one or more of (a) on-site elevator monitoring equipment, or (b) elevator diagnostics performed by program routines of said at least one controller.

5. An elevator system according to claim 4 further comprising:

one or more remotely-operable power relays providing electric power to one or more said controllers; and wherein said means causes said POR by operating at least one said power relay to remove power from said at least one controller for an interval and then restoring power to said at least one controller.

6. A system according to claim 4 wherein:

said means causes at least one said controller to perform an internal POR.

* * * * *